US005231612A

United States Patent [19]

Allgaier et al.

[11] Patent Number: 5,231,612

[45] Date of Patent: Jul. 27, 1993

[54] POSITION DETECTION AND CORRECTION MECHANISM FOR A TIMEPIECE

[75] Inventors: Jürgen Allgaier, Lauterbach; Wolfgang Ganter, Schramberg; Roland Maurer, Lauterbach, all of Fed. Rep. of Germany

[73] Assignee: Junghans Uhren GmbH, Schramberg, Fed. Rep. of Germany

[21] Appl. No.: 937,372

[22] Filed: Aug. 31, 1992

[30] Foreign Application Priority Data

Aug. 29, 1991 [DE] Fed. Rep. of Germany ..... 4128752

[51] Int. Cl.[5] ..... G04C 11/02; G04C 9/00

[52] U.S. Cl. ..... 368/47; 368/187

[58] Field of Search ..... 368/46–47, 368/69–70, 185, 187, 250, 256

[56] References Cited

U.S. PATENT DOCUMENTS 4,420,263 12/1983 Besson et al. ..... 368/80

4,645,357 2/1987 Allgaier et al. ..... 368/187

FOREIGN PATENT DOCUMENTS 3828810 3/1990 Fed. Rep. of Germany .

*Primary Examiner*—Vit W. Miska

*Attorney, Agent, or Firm*—Burns, Doane, Swecker & Mathis

[57] ABSTRACT

A radio-controlled timepiece contains a mechanism for the detection and correction of a hands setting. The mechanism includes a sender and a receiver for sending and receiving, respectively, a radiation beam. A hands setting mechanism includes an hour wheel, a minute wheel, and a seconds wheel, each possessing an aperture therethrough. The hour wheel has a front mirror located proximate the beam sender for reflecting a beam to the receiver. The front mirror has an interruption defined by the aperture of the hour disk in order to pass the beam through that aperture to a rear mirror disposed remote from the sender, such that a beam reflects from the rear mirror only after passing through aligned apertures in the disks. The hour wheel is movable independently of the minute wheel and seconds wheel, and the minute wheel and seconds wheel are rotatably interconnected.

12 Claims, 3 Drawing Sheets

POSITION DETECTION AND CORRECTION MECHANISM FOR A TIMEPIECE

BACKGROUND OF THE INVENTION

The invention concerns a timepiece having a mechanism for the detection and correction of a hands setting, especially in a radio-controlled timepiece.

A mechanism for the detection and correction of a hands setting in a timepiece includes a sender and a receiver for sending and receiving, respectively, a radiation beam. Apertured disks are joined for rotation with the wheels of a hands setting mechanism. One of the disks has a front mirror located approximate the beam sender for reflecting a beam to the receiver. The front mirror has an interruption for passing the beam toward a rear mirror which is disposed remote from the sender, such that a beam reflects therefrom only after passing through apertures in the disks.

An apparatus of this type is known from German Patent No. 38 28 810. It comprises a reflex light barrier with a rotating diaphragm or disk system in front of a mirror pattern extending over different arc lengths. The light barrier generates a beam of radiation. The diaphragm or disk system comprises on the side of incoming radiation an interrupted mirror coating on the seconds wheel of a hands mechanism, which cooperates with it intermediate wheel in the form of an apertured diaphragm in the beam path. To obtain unambiguous angular position detection results, a diaphragm disk combination is located in front of the minute wheel mirror coating, which disk combination comprises the seconds wheel and its intermediate wheel. However, the light barrier evaluation of the different shadowing and passage positions of the diaphragm apertures in the beam path is relatively expensive and requires a relatively long period of time for the pivoting all of the hands drivingly or fixedly connected with the wheels into a predefined reference position, from which they may be advanced into the angular position for the prevailing hands time display in front of the scale face of a radio controlled timepiece of the type described in more detail in U.S. Pat. No. 4,645,357. While the provision of a light barrier in the wheels area of the gear works makes it possible to eliminate a visually disturbing direct optronic query of the angular position of the hands in the face of the timepiece, the apertured diaphragm system is far from optimal with respect to the configuration of the works and the expense of the motor controls.

SUMMARY OF A PREFERRED EMBODIMENT OF THE INVENTION

In view of these conditions, it is an object of the invention to provide an apparatus of this generic type in a manner such that a simpler query of position and the transfer of the display elements into a predetermined display position, in particular a reference position, may be carried out.

This object is attained according to the invention wherein the disk on which the front mirror is formed comprises an hour disk which is joined for rotation with an hour wheel (i.e., the hour disk is preferably defined by the hour wheel). The hour disk is movable independently of the remaining disks, and those remaining disks are rotatably interconnected.

Accordingly, the wheel having the front mirror is the hour wheel. This hour wheel is the first wheel which a beam counters and is moved, preferably by its own separate motor, independently of the wheels for another display element. The rear reflector is preferably a mobile reversing mirror (or a stationary mirror behind a moving apertured disk) and is positioned in the beam path. Coaxially arranged with and behind the minute wheel and the seconds wheel, so that the proven cost effective configuration of a standard hands mechanism may be used in the invention. The rear mirror function for the deflection of the beam is carried out by a third wheel located behind an intermediate wheel, both of which are located eccentrically relative to the hands shaft axis, in order to be able to use a proven, readily assemblable conventional timepiece wheel mechanism.

Two drive motors are used which are controlled independently of each other. One of the motors is acting via the intermediate wheel on the seconds wheel, and further acts via the operating coupling of the third wheel on the minute wheel. For the drive of the hour display, the other motor with a gear reduction is provided.

The drive motors, in keeping with the technology of electromechanical clock mechanisms in general use at the present time, are preferably bipolar stepping motors. Those motors are conveniently exposed at the start of the operation to a pulse of random polarity, so that they react uniformly to subsequent actuation with inverse polarity, if the beam barrier system is to be adjusted in a defined manner, so as to be able to move from a not yet unambiguous reflect situation into an unambiguous reference position. The presence of a reflex signal could initially be caused by the beam path traveling freely to the rear mirror through all of the apertured disks, or it could be caused by the mirror coating of the foremost wheel on the inlet side being located in the beam path so that the foremost wheel (in an arbitrary position with respect to the apertured disks located behind it)is not in the reference position. If the reflex signal is caused by the beam reflecting not from the front mirror, but rather from the rear mirror, then the signal would disappear when the rear disks are moved out of their instantaneously aligned position. For this reason, their gear works is briefly actuated. If this does not lead to the interruption of the reflex signal, the later must be caused by the beam path being reflected by the front mirror. The disk of the latter is then driven for adjustment until the front mirror is interrupted. In this manner, the reference position of the hour wheel and the display means (for example an hour hand) may be obtained. As the reflex signal has now disappeared, the other apertured disks are again moved until their holes are aligned with an aperture (i.e., an interruption) in the front mirror, so that the beam path now reflects from the rear mirror, whereupon the beam reflex signal reappears. This also causes the other display means (minute and seconds hands) to pivot into the reference position, from which they may be moved into the display positions corresponding to the given absolute time, as is known as such for radio timepieces.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
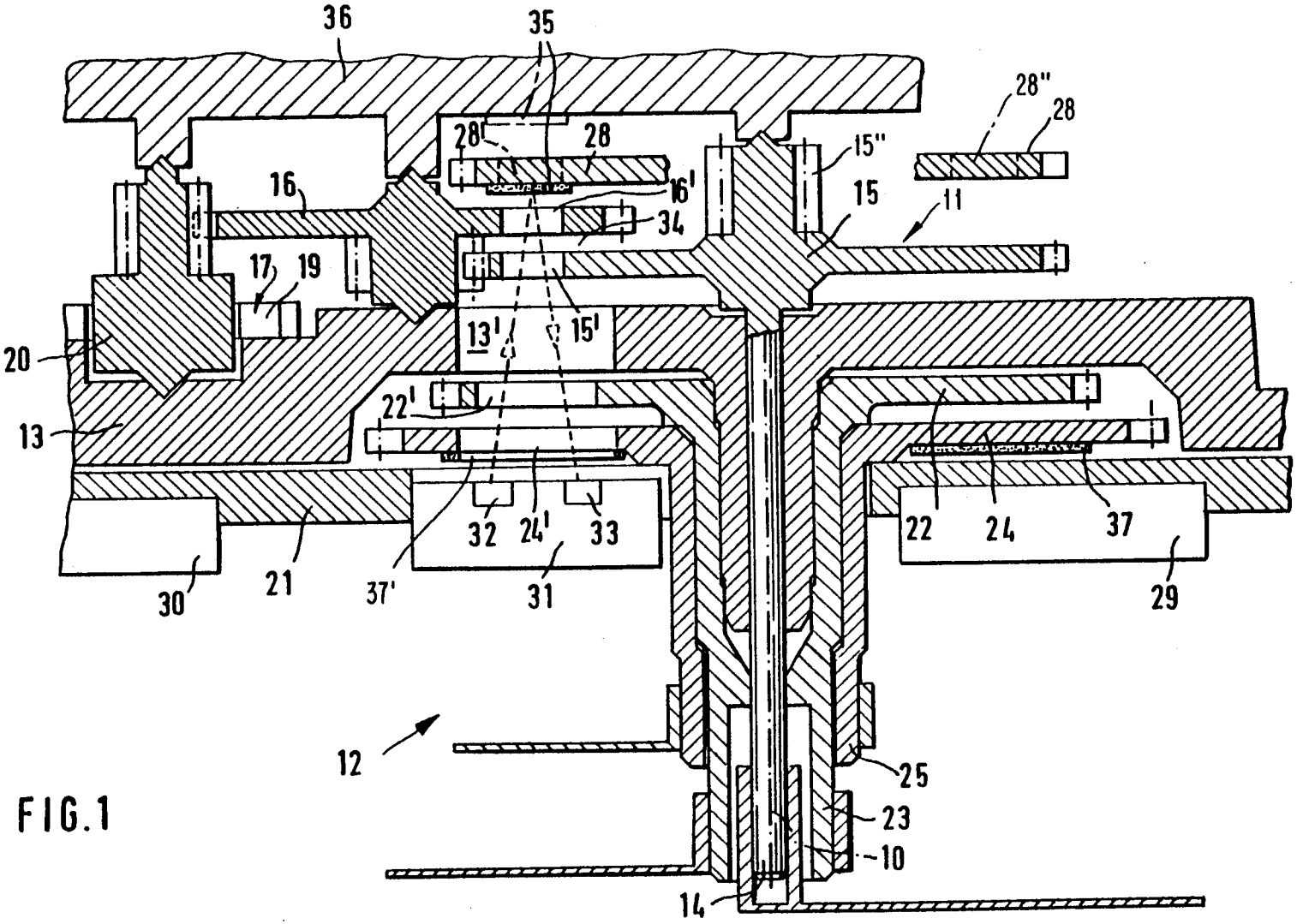
FIG. 1 is a fragmentary longitudinal sectional view through the axis of the hands shaft and of one of two independently controlled motors, in a radio timepiece mechanism equipped with hands.

Depicted in FIG. 1 is a mechanism 11 for driving a hands time display of a radio-controlled timepiece. That mechanism includes a seconds hand shaft 14 mounted for rotation about an axis 10 in a fixed bottom plate 13. The shaft 14 is connected fixedly with a seconds wheel 15. The latter is driven, as known as such from the technology of step motor driven quartz timepiece wheel mechanisms, by means of an intermediate wheel 16 continuous or preferably discontinuously. The driving force is provided by a seconds motor 17 which includes a rotor 20 surrounded by a stator 19. Mounted coaxially with the seconds wheel 15, between the bottom plate 13 and a circuit board 21 (which overlies the front of the mechanism 11) is a minute wheel 22 and its minute hand shaft 23, as well as an hour wheel 24 and its hour hand shaft 25. The minute wheel 22 is driven by the seconds wheel 15 by means of a drive transmission 28' (see FIG. 2 which includes a third or rear wheel 28). The wheel 28 is located in the rear of the mechanism 11 and is connected to teeth 15'' of the seconds wheel.

The rear wheel 28 and the intermediate wheel 16 are rotatable about respective axes which are eccentrically disposed relative to the axis 10. The hour wheel 24 is driven by its own motor 26 (see FIG. 2) in order to avoid gear shifting. For reasons of torque balance, the motor is connected to a reducing gear 27, so that the hour hand is advanced for example at a stepping rate of 1/60 Hz (i.e., one step per minute).

The rear wheel 28 and the intermediate wheel 16 are rotatable about respective axes which are eccentrically disposed relative to the axis 10.

The circuit board 21 carries (i) a radio signal-receiving timepiece circuit 29 to receive and decode absolute time information, (ii) a control circuit 30 for the timekeeping function and, if necessary, for correcting the drive of the mechanism 11, and (iii) a reflex barrier 31. The latter operates in the visible or invisible light spectrum range and includes a sending part 32 and a receiving part 33 for the hands position detection. The beam from the sending part 32 travels through a path 34 in which are disposed a plurality of apertured disks or diaphragms comprised of the bottom plate 13, the seconds wheel 15, the intermediate wheel 16, the minute wheel 22, and the hour wheel 24, which elements include apertures 13', 15', 16', 22' and 24', respectively. While the disks are shown as comprising portions of their respective wheels (i.e, as being defined by their respective wheels), the disks could be separate from those wheels and connected therewith. In either event, the disks are joined for common rotation with their respective wheels.

A rear mirror 35 is mounted on the front side of the wheel 28 so as to be registerable in alignment with the apertures 16', 15', 13, 22' and 24'. Alternatively, that mirror could be positioned on a rear wall 36, as shown in phantom lines, whereupon an aperture 28, would be provided in the wheel 28 to admit the beam to the mirror 35. As yet another possibility, the rear mirror could be mounted on the wheel 28 behind aperture 28'.

The hour wheel 24, which is nearest to the sending-receiving parts 32, 33 of the barrier 31, is provided with a front mirror coating 37 which extends annularly around the hour wheel 24, and which is of sufficient width (i.e., outer radius minus inner radius) to overlie the entire beam pat 34. The mirror 37 has a hole 37' formed therein which is of sufficient width to permit passage of the beam.

A reference position (shown in FIG. 1) wherein all of the holes 37', 24', 22', 15', and 16' (and hole 28' if the mirror is mounted on the wall 36 instead of in front of hole 28') are aligned in order to form an uninterrupted beam path 34 between the sender part 32 and the receiving part 33 of the reflex barrier 31, which alignment occurs every two revolutions of the minute wheel 22. The barrier 31 supplies a reflex signal 38 to the control circuit 30 when the wheels are in the reference position, and also when the hour wheel 24 occupies any position other than that shown in FIG. 1 because the beam would then be reflected from the mirror 37. There is no reflex signal 38 only when (i) the hole 37' overlies the barrier 31, and simultaneously (ii) at least one of the other wheels has its aperture non-aligned with the beam path. Under all other conditions, the receiving part 33 receives a reflected beam.

The motors 17, 26 are bipolar step motors, driven by pulses of alternating pulse polarity. It would be possible to provide a conventional rotor position detector, which upon the activation of the timepiece 12 (for example by the insertion of a battery 39) presets the driver circuit 40 so that the first drive pulse 41 to be emitted always has a polarity generating a torque in the instantaneous rotor position. However, the use of such a detector circuit is too expensive in view of the pricing requirements relative to a consumer timepiece.

The present invention provides an arrangement which avoids the need for a detector circuit. In accordance with the present invention, the initial actuation of the timepiece 12 is effected by means of a single pulse generator 44 which triggers an actuation pulse 42 for creating a single drive pulse 41 of an arbitrary instantaneous polarity. The pulse 42 is supplied to the motors 17, 26 at their randomly assumed rotor positions. If this pulse is of a polarity suitable to build up a torque, then the respective rotor is turned by one step (one-half revolution), i.e., into the position wherein this polarity of the drive pulse 41 would not generate a torque. If, on the other hand, the polarity of the first drive pulse 41 did not build up a torque in motor 17 or 26, then the respective rotor must already be in the desired position so it is not rotated, i.e., it remains in this position. The next pulse of reverse polarity in these rotor positions leads to an advance by one step, in any case. Thus, it is assured that, subsequent to the triggering of an initial actuating pulse 42, both motors 17, 26 will have the same initial position relative to the actuating polarity and therefore will exhibit the same switching behavior upon subsequent actuation from the drive circuits.

If, upon the initial actuation, a reflex signal 38 appears (i.e., "yes" at Step 1 in FIG. 3), it is not known whether it is due to a reflex from the front mirror 37 or the rear mirror 35. It is thus necessary to adjust the wheel system so that in the absence of a continuous beam path 34 no reflex signal 38 appears. The reflex signal 38 therefore actuates the driver 40 for the seconds motor 17 with an inverse polarity relative to the afore-mentioned initial drive pulse 41, so that the motor 17 carries out a step from the given position, thereby displacing the intermediate wheel 16 by at least an angular distance equal to the diameter of its hole 16'. The inquiry of whether a signal 38 appears is then repeated. If, by chance, the hole 37' is standing in the beam path 34 (i.e., "no" at Step 2), then the hour motor 26 is advanced by a hole width, so that the inlet mirror 37 again generates a reflex signal 38.

Figure 3:
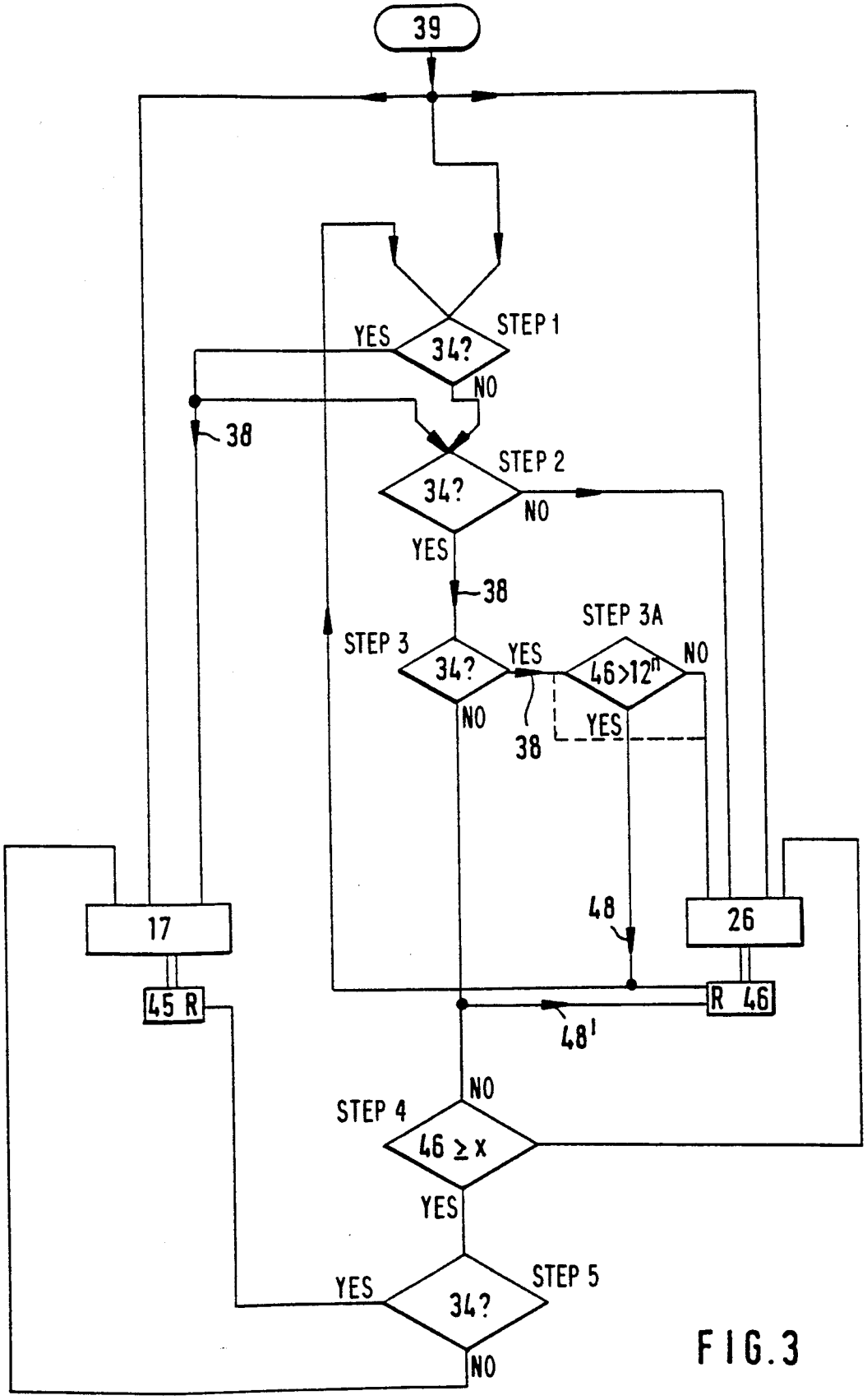
FIG. 3 is a flow chart showing the alternative actuation o two motors in order to find the display reference position following the activation of the timepiece.

Upon the reappearance of a reflex signal 38, the instantaneous position of an hour position detector 46 is queried; the hour position detector preferably counts the accumulated advance steps of the motor 26, in order to avoid a more expensive absolute angle coder for the hour disk 24. By means of a query stage 47, the motor 26 is actuated until a full hour hand revolution has been counted, whereupon by means of a reset signal 48 the detector 46 is reset to zero and the previous play of the query and advance is repeated, as shown by the loop left from the enter of FIG. 3 upwards. Now, in view of the preceding reset, the query of the hour position detector 46 again yields necessarily instantaneous values in the reference position, which preferably (as indicated in FIG. 3) is the 12 o'clock position of the hour hand on a 12 hour clock face. The hour motor 26 is advanced until the reflex signal disappears, in order to again emit an hour reset signal 48'. The hour motor 26 is then operated until its position detector 46 shows a predetermined number of x forward steps, which approximately represent the center of the interruption in the front mirror 37, thereby ensuring that the beam path 34 is free in a stable manner (while a merely approximate release could again be interrupted by gear clearances, thereby leading to malfunctioning).

After having moved the hour disk 24 (in the case of a hands-type of timepiece this will occur as the hour wheel and its hour hand are rotated) to the reference position, the seconds motor 17 is operated until the barrier 31 again indicates a continuous beam path 34 and the seconds position detector 45 is reset into its zero position. Now all of the hands are in their reference position and from here on the motion of the hands is also counted in order to at first rotate them in rapid motion into an absolute time position corresponding to the information received and decoded in the ratio timepiece 12 and then to advance them in a normal timekeeping.

Figure 2:
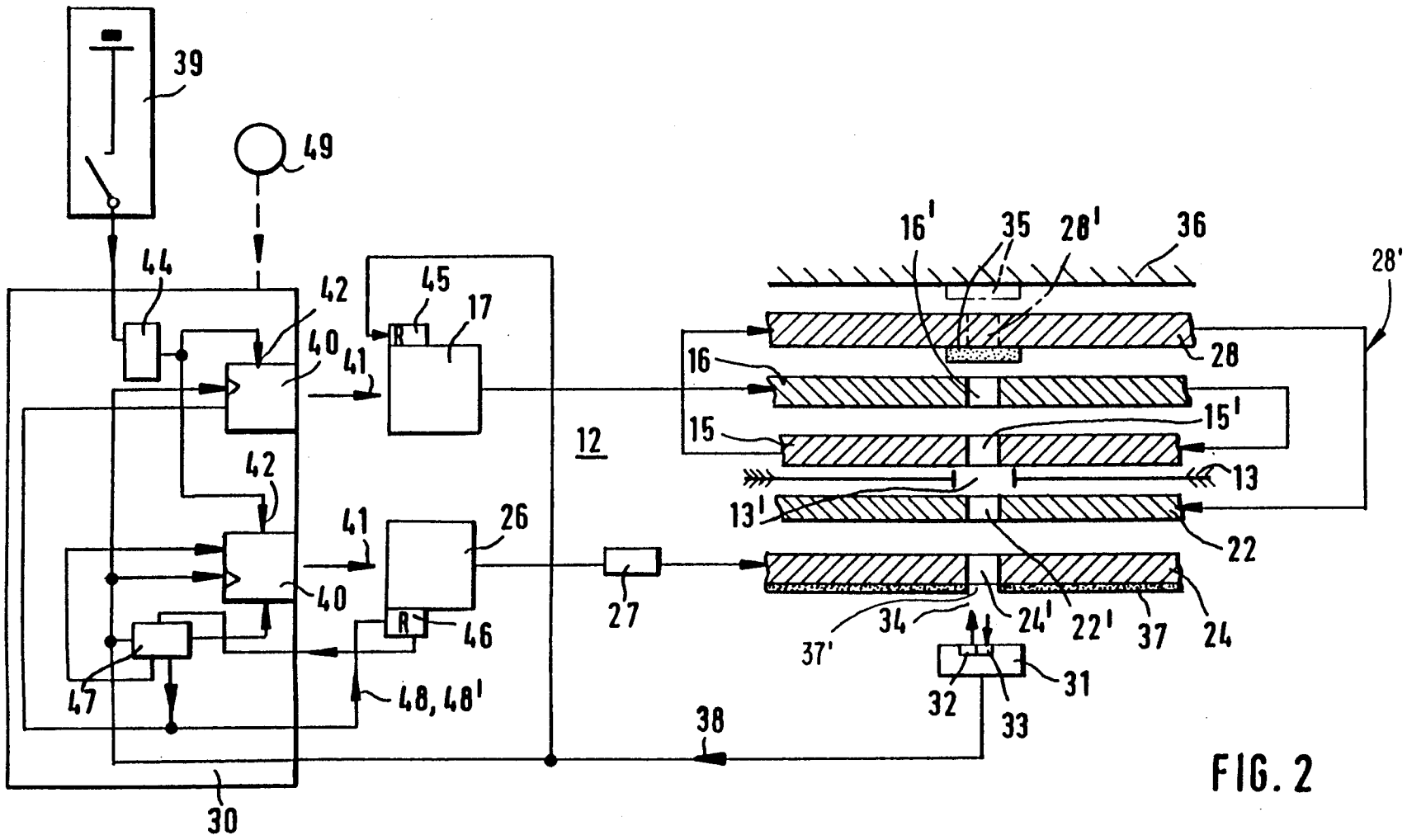
FIG. 2 is a schematic fragmentary representation of the apertured disks and control mechanism.

In FIGS. 2 and 3 the effect of a manually actuated stop circuit 49 is indicated by a broken line, which essentially results in the bridging over of the query of the hour hand position detector 46. This leads to the result that the hour wheel 24 stops following the first attainment of the reference position if the beam path 34 is blocked behind the hole 24' in the front mirror. Subsequently, the query of the barrier 31 effects the further rotation of the rear disks, into the coaxial position of their apertures so that the beam path 34 is opened to the rear mirror 35. The disks are now all in their reference position, so that the seconds, minute and hour hands may be set into their 12 o'clock position without having to wait for this terminal assembly process of timepiece manufacturing for the above-described complete play of the wheels of the two drive motors 117, 26 to be set correctly relative to each other. This waiting period for the rotation into the hands setting position may even be halved by providing the rear disk 28 in addition to the rear beam path mirror 35 considered heretofore, with a second hole offset by 180°, i.e., diametrically opposite the first hole 28' as shown in phantom lines in FIG. 1. In this case, with the our wheel 24 immobile in the reference position, the beam path 24 is opened at the latest not after two complete revolutions of the minute wheel, but rather after one revolution. Following the setting of the hands, this bridging function of the stop circuit 49 is discontinued and the apertured disks move into the reference position relative to each other given by the kinematics of the timepiece mechanism.

Although the present invention has been described in connection with preferred embodiments of the invention, it will be appreciated by those skilled in the art that additions, modifications, substitutions, and deletions not specifically described may be made without departing from the spirit and scope of the invention as defined in the appended claims.

What is claimed is:

1. In a timepiece having minute and hour hands; a hand-setting mechanism including an hour wheel; and a correcting means for the detection and correction of a hands setting; said correcting means including: a sender and receiver for sending and receiving, respectively, a radiation beam, apertured disks joined for rotation with said hands setting mechanism, one of said disks having a front mirror located proximate said beam sender for reflecting a beam to said receiver, an aperture of said one disk defining an interruption in said front mirror for passing the beam through that aperture, a rear mirror disposed remote from said sender such that a beam reflects from said rear mirror only after passing through apertures in said disks, the improvement wherein said one disk on which said front mirror is formed comprises an hour disk joined for rotation with said hour wheel, said hour disk being movable independently of the remaining disks, said remaining disks being rotatably interconnected.

2. Apparatus according to claim 1, wherein said remaining disks include a minute disk joined for rotation with a minute wheel, a seconds disk joined for rotation with a seconds wheel, a rear wheel, and an intermediate disk; said minute disk, said seconds disk, and said intermediate disk all being situated between said hour disk and rear disk with reference to the travel of a beam from said sender.

3. Apparatus according to claim 2, wherein said rear disk has an aperture, said rear mirror being disposed behind said rear disk.

4. Apparatus according to claim 3, wherein said rear disk has an additional aperture located diametrically opposite the first-named aperture.

5. Apparatus according to claim 2, wherein said rear mirror is formed on a surface of said rear disk which faces said sender.

6. Apparatus according to claim 2 including a motor connected to drive said intermediate disk; said seconds wheel being driven by said intermediate disk; said rear disk being driven by said seconds wheel; said minute wheel being driven by said rear disk; said hour wheel, said seconds wheel and said minute wheel all being rotatable about a common axis.

7. Apparatus according to claim 1 comprising a first bipolar step motor connected to drive said hour wheel, and a second bipolar step motor connected to drive said remaining disks.

8. Apparatus according to claim 7, wherein only a single pulse generator is provided, said pulse generator generating an actuating pulse of random polarity for both of said first and second motors.

9. Apparatus according to claim 8, including a reducing gear connected to said first motor and to said hour wheel.

10. Apparatus according to claim 2, wherein said hour, minute and seconds disks are defined by the hour, minute, and seconds wheels, respectively.

11. Apparatus according to claim 2, wherein said hour, minute, and seconds wheels rotate about a common axis, and said rear and intermediate wheels are eccentrically disposed relative to said axis.

12. Apparatus according to claim 1, wherein said timepiece comprises a radio-controlled timepiece having a radio signal receiver operably connected to said hands setting mechanism.

* * * * *